US005735187A

United States Patent [19]

Harju

[11] Patent Number: 5,735,187

[45] Date of Patent: Apr. 7, 1998

[54] PNEUMATICAL PISTON-CYLINDER UNIT HAVING A HYDRAULIC CONTROL MEANS

[75] Inventor: Bert Harju, Harads, Sweden

[73] Assignee: Pos-Line Aktiebolag, Harads, Sweden

[21] Appl. No.: 446,853

[22] PCT Filed: Nov. 30, 1993

[86] PCT No.: PCT/WE93/01033

§ 371 Date: Jun. 5, 1995

§ 102(e) Date: Jun. 5, 1995

[87] PCT Pub. No.: WO94/13962

PCT Pub. Date: Jun. 23, 1994

[30] Foreign Application Priority Data

Dec. 11, 1992 [SE] Sweden ..... 9203737

[51] Int. Cl.[6] ..... F15B 15/26

[52] U.S. Cl. ..... 91/44; 91/45; 92/8; 92/28

[58] Field of Search ..... 91/41, 44, 45; 92/8, 27, 28

[56] References Cited

U.S. PATENT DOCUMENTS

| | | | |
|---|---|---|---|
| 2,664,859 | 1/1954 | Green . | |
| 3,149,541 | 9/1964 | Huttel et al. | 92/8 |
| 3,264,943 | 8/1966 | Schmitt | 91/45 |
| 3,302,533 | 2/1967 | Hutter et al. . | |
| 3,313,214 | 4/1967 | Ackerman | 92/8 |
| 3,678,805 | 7/1972 | Weyman . | |
| 3,824,900 | 7/1974 | McLellend | 92/8 |
| 4,526,088 | 7/1985 | Reuschenbach et al. | 92/8 |

FOREIGN PATENT DOCUMENTS

| | | | |
|---|---|---|---|
| 819353 | 9/1959 | United Kingdom | 92/8 |

*Primary Examiner*—Thomas E. Denion
*Attorney, Agent, or Firm*—Larson and Taylor

[57] ABSTRACT

A pneumatic piston-cylinder unit has a cylinder (1) in which an air piston (4) with a tubular piston rod (5) is reciprocably actuated by compressed air from two main air channels (18, 19). The air cylinder (1) includes an integrated hydraulic control system (6) having an actuation device (8) which is fixedly mounted in the air cylinder (1) for creating a flow of hydraulic fluid through hydraulic control system (6) when compressed air is present in the main air channels (18, 19) and for stopping the flow of hydraulic fluid and thereby preventing the air piston from moving when there is no compressed air in the main channels (18, 19). A piston (34) and a cylinder (28) of the hydraulic control system (6) are displaceable an adjustably long distance in relation to each other to make it possible to open and close, respectively, a larger or smaller hydraulic fluid passageway thereby controlling the moving speed of the air piston (4) while maintaining the air pressure. The air cylinder includes an indication system (15, 16, 40) for setting the piston stroke of the air piston (4) and the exact location of the axial piston movement.

11 Claims, 3 Drawing Sheets

PNEUMATICAL PISTON-CYLINDER UNIT HAVING A HYDRAULIC CONTROL MEANS

The present invention generally relates to a pneumatical piston-cylinder unit of the type which is commonly sued in many industrial fields for actuating various machine parts or objects by a predetermined force. For this purpose it is many times possible to chose between electrical, pneumatical or hydraulical actuation means. Pneumatical and hydraulical actuation menas are usually utilized in cases where compressed or hydraulic power is available.

A hydraulic piston-cylinder unit is advantageous in several respects over pneumatical piston-cylinder units, in the following referred to as "air cylinders". Since, however, air cylinders usually have a substantially lower purchase cost, are simplier to manage and install, can be formed with less dimensions, are formed so that there is no need to bother about managing hydraulic oil, which sometimes causes problems, etc., pneumatical cylinders are in many cases chosen instead of hydraulic cylinders.

"Air cylinders", however, suffer from some disadvantages in air cylinders a piston operates between the two ends of the cylinder, which ends thereby define the piston stroke. If it should be desired to change said piston stroke this has usually been made by means of external magnetos, mechanical stop means and similar means. Such means necessarily make use of external cables, conduits, mechanical stop means etc. which often are considered as obstacles and which may cause problems and operation errors.

Another limitation of air cylinders is that the piston usually "creeps" when the compressed air is cut off depending on the compressability of the air, said creeping may follow in the former direction of power, or in the opposite direction in case the cylinder is acted on by an outer counter power, whereby the air cylinder "creeps" or becomes more or less resiliently compressed. The same problem appears in case the compressed air unintentionally drops out depending on operation troubles or for any other reason. It is therefore not possible to block the piston exactly in the position it takes when the air was cut off or dropped out.

It is also difficult or impossible to, more or less exactly, control the moving speed of the air piston, since the speed is depending on the air pressure and on the counter pressure, respectively, that the piston is subjected to. Further, the air piston generally starts moving hesitatingly and with a successively increased movement. The only possibility of controlling the maximum speed of the air piston is, in most cases, to reduce the air pressure, but in such case the piston, or course, also gets a correspondingly reduced actuation power.

It may also be a problem that the air piston normally always has a maximum speed in the very moment that the piston is to be stopped at the end of its stroke.

The basis of the invention therefore has been the idea of combining a conventional air cylinder with a hydraulic unit, which

- both foresees that the air piston remains steadily blocked exactly in the position the piston takes when the air pressure is cut off or drops out,
- makes it possible to control and to reduce the moving speed of the air piston,
- makes it possible to reduce the moving speed of the air piston without the need of changing the air pressure and without changing the actuation power for the air piston,
- and makes it possible to adjust the stroke of the air piston within very narrow tolerances.

It is known in the art to utilize hydraulic means in combination with air cylinders in various connections. Thus, SE-A 363.664, as an example, discloses an air cylinder, in which a hydraulic system is utilized, in which a liquid dampens the moving speed of the air piston following a controllable choking of the flow passageway of the hydraulic fluid, like in a so called hydraulic shock absorber. The same function is obtained in the U.S. Pat. Nos. 2,664,859 and 3,302,533 and in the German publication DE-A 1,625,651.

All said known apparatus, however, only provide a damping, in some cases a controllably strong damping, of the moving speed of the piston or of the movement of the air piston just preceding the stopping thereof, but none of said publications discloses an apparatus in which the piston can be effectively stopped and can be positively kept exactly in the position that the piston takes when the air pressure is being cut off or drops out, and in which position the piston is consequently held in an exactly unchanged position even if it is subjected to a counter pressure acting from outside the air piston.

Also, none of the said publications discloses a pneumatical piston-cylinder arrangement in which it is possible to control the piston stroke within very narrow limits as can be done by means of the present invention.

Thus, the invention relates to a pneumatical piston-cylinder unit, named "air cylinder", having a possibility of being actuated and controlled by a hydraulic means, in which the hydraulic system makes it possible to control the moving speed of the air piston within wide limits, for instance between nearly 0% and 100%, and whereby the air piston can still be actuated with an unchanged actuation power. This makes it possible to control the stroke of the piston within very narrow limits, for instance with an accuracy of down to 0.5 mm, and in which the hydraulic system of the apparatus is built integral with the air power unit, and therefore said power unit has no exterior conduits, tubes or hoses whatsoever, and which apparatus, in particular, is formed so that the air piston is kept steadily blocked exactly in the position the piston takes when the air pressure is cut off or drops out.

An air cylinder of said type having an integrated hydraulic system of the above mentioned type is so flexible that it is possible to reduce the stock-keeping of air cylinders to an absolute minimum, since one and the same air cylinder can be used for very varying power demands and for very varying piston stroke needs. At the same time the invention solves the problem with "creeping" air pistons, and therefore the simple and relatively cheap air cylinder according to the invention can be used instead of the hydraulic cylinders which have so far been preferred for many purposes, and which are substantially more expensive and difficult to handle.

Now the invention is to be described more in detail with reference to the accompanying drawings which illustrate, without limiting the invention, an example of an air cylinder having a hydraulic control means according to the invention.

In the drawings

Figure 1:
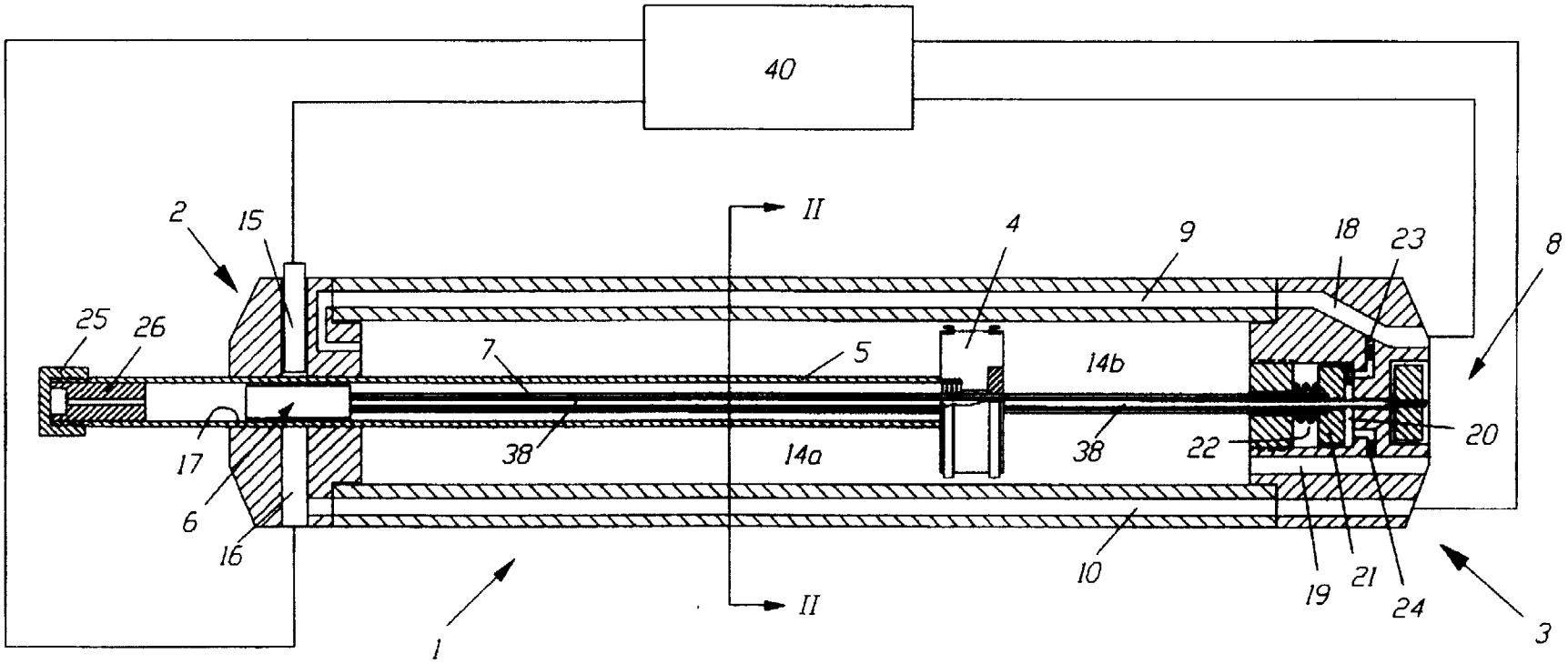
FIG. 1 shows an axial cross section through a diagrammatically illustrated air cylinder having an integrated hydraulic control means according to the invention.
Figure 2:
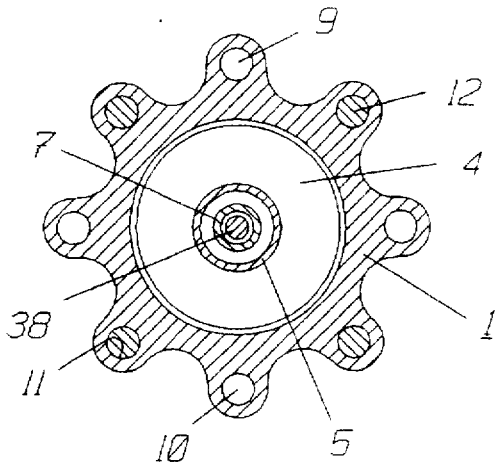
FIG. 2 shows a cross section through the cylinder of FIG. 1, seen along line II—II.
Figure 3:
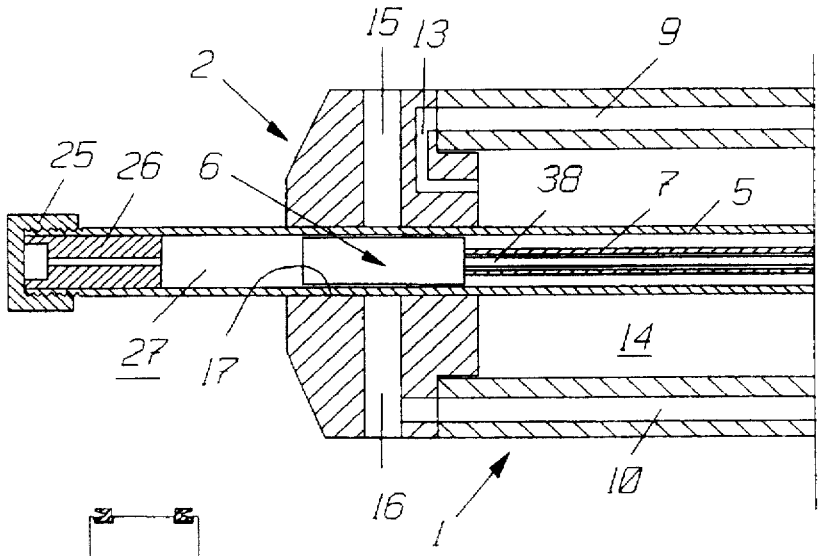
FIG. 3 shows, in an enlarged scale, the left hand end of the cylinder of FIG. 1.
Figure 4:
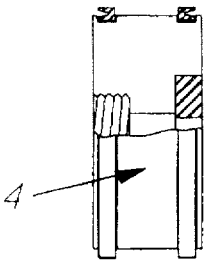
FIG. 4 shows the air piston in the same scale.

The pneumatic piston-cylinder unit shown in FIG. 1, named "air cylinder", having a hydraulic control means, generally comprises an air cylinder 1 having a front end 2, a rear end 3 and a piston 4 with a piston rod 5, which is reciprocatable in the cylinder, a hydraulic control unit 6 with a lock piston rod 7 and means 8 for actuating the hydraulic control unit 6.

The air cylinder 1 is formed as a cylinder which in a cross section view is formed almost like a star, and which at the star points comprises at least one air channel 9, and least one cable channel 10 and several, for instance four, bolt channels 11 for joining bolts 12, by means of which the air cylinder 1, the front end 2 and the rear end 3 are joined to form an integral unit.

The front end 2 is formed with a substantially U-shaped air channel 13 which supplies compressed air to the cylinder chamber 14 at the front chamber side 14*a* of the piston 4. The front end 2 also is formed with axial bores coinciding with the bolt channels 11, and through which the joining bolts 12 extend, and with two radial position reading channels 15, 16 which extend as far as to the axial bore 17 for the piston rod 5. The position reading channels 15 and 16 are axially offset a slight distance in relation to each other, for instance so that the position channel 16 is located 0.5 mm axially outside the position channel 15 for a purpose which will be explained more closesly in the following.

The rear end 3 is formed with two axial compressed air channels, one channel 18 of which is arranged to direct compressed air through the cylinder air channel 9 to the front side chamber 14*a* of the cylinder chamber 14, and the other channel 19 of which is arranged to direct compressed air to the rear side 14*b* of the cylinder chamber 14. The rear end also is formed with an actuation chamber 20 for a piston 21 belonging to hydraulic actuation means 8, which piston 21 is biassed rearwardly from the cylinder chamber 14 by a compression spring 22 which is mounted at the front side of the piston 21. A narrow air side-channel 23, 24 leads from each of the air channels 18, 19 into the actuation chamber 20 at the rear side of the piston 21. In each of the air side-channels there is a nonreturn valve of a type which allows introduction of compressed air into the chamber 20 from either of the two valves but not a draining of air through the opposite valve until the pressure has ceased in the respective main air channel 18, 19. Alternatively two separate pressure chambers may be provided, one chamber for the return air channels 18, 23 and a second chamber for the supply air channels 19, 24. Alternatively the piston 21 may be formed as a cylinder in which an inner piston is reciprocatable, and in which arrangement one of the air side-channels, e.g. channel 23, opens into the chamber inside the inner piston and the other air side-channel 24 opens into the main chamber 20 outside the inner piston. It is important that the piston 20, when compressed air is present in either of the main air channels 18 or 19 is biassed inwardly against the action of the spring 22, and that said piston 20 is pressed back to its initial, retracted position by the return spring 22 as soon as the pressure ceases in the main air channel.

The piston carries a tubular piston rod 5 which displacably extends through a sealing (not shown) in the front end piece 2, and which at the extreme outer end thereof has a sealing end cap 25 having a passageway with a stop screw 26 for filling of hydraulic fluid in a hydraulic chamber 27 formed in the inner of the tubular piston rod 5. The end cap 25 serves to sealingly close the hydraulic chamber 27 of the tubular piston rod 5. At the extreme end of the tubular piston rod 6 there can, as usual, be connection means for different machine elements etc. which are to be actuated by the air cylinder.

As best evident from FIGS. 5–8 the hydraulic control unit 6 comprises a cylinder 28 which, over a tubular lock piston rod 7, is fixedly connected to the hydraulic control piston 21 of the actuation means 8, and which upon a displacement of the hydraulic control piston 21 can be moved a like long distance as said piston. The control cylinder 28 is displacable inside the tubular piston rod 5 over a double acting central sealing 29. On each side of the sealing 29 the cylinder has a radial through bore 30, 31 for allowing hydraulic fluid to flow therethrough thereby being moved from one side 27*a* of the hydraulic chamber to the opposite side 27*b* thereof, and vice versa. For cooperation with said bores 30, 31 the cylinder is exteriorly formed with axial channels 32 and 33 resp. extending axially along the exterior surface of the cylinder 28, and over which channels hydraulic fluid can be moved from one side of the hydraulic chamber, through the cylinder 28 and to the opposite side of the hydraulic chamber 27. A double acting hydraulic control piston 34 is mounted inside the hydraulic control cylinder 28. The control piston 34 has two axially spaced piston sealings 35, 36 and between said sealings a transfer chamber 37 through which hydraulic fluid can, in some casses, pass on its way between the two sides 27*a* and 27*b* of the hydraulic chamber 27. The two piston sealings 35, 36 are arranged on a distance from each other which is greater than the axial distance between the radial hydraul fluid channels 30, 31 of the control cylinder 28.

Figure 5:
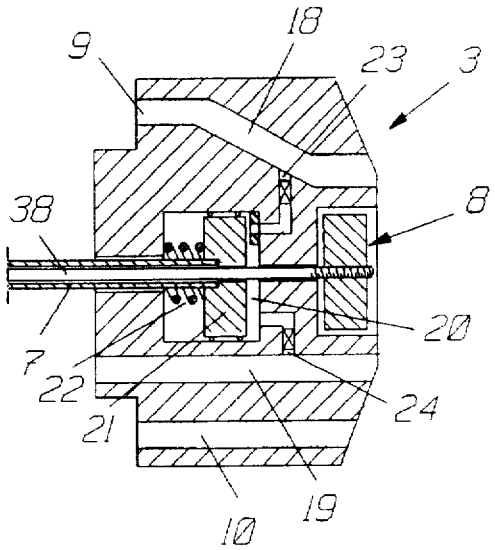
FIG. 5 shows, likewise in the same scale, the right hand end of the air cylinder of FIG. 1.

The control piston 4 is fixedly connected to a control nut, see the arrow 8 in FIG. 5, exteriorly of the rear end 3 over an axial bar 38. Said bar 38 is displacable through the rear end piece 3 over a sealing.

The control cylinder 28 and the control piston 34 are, in their non-active condition, positioned in relation to each other, assisted by the lock piston rod 7 of the cylinder 28 and the bar 38 of the piston 34 such that a part 39 of the piston 34 and its piston sealing 35 blocks the outlet and inlet of the forwards facing radial hydraulic channel 31 of the cylinder 28, and so that the same hydraulic channel 31 becomes completely or partly opened when the hydraulic cylinder 28 is moved in the direction towards the front end piece 2 in relation to the stationary piston 34. This is done when compressed air is present in either of the main air channels 18 or 19, and when the hydraulic fluid opening channel 21 as a consequence thereof is being moved against the action of the compression spring 22.

By adjusting the base position or the hydraulic piston 34 in relation to the hydraulic cylinder 28 by means of the control nut (the arrow 8) it is possible to set the maximum degree of opening for the radial hydraulic channel 31 in the cylinder 28 from practically no opening at all to full opening.

Figure 6:
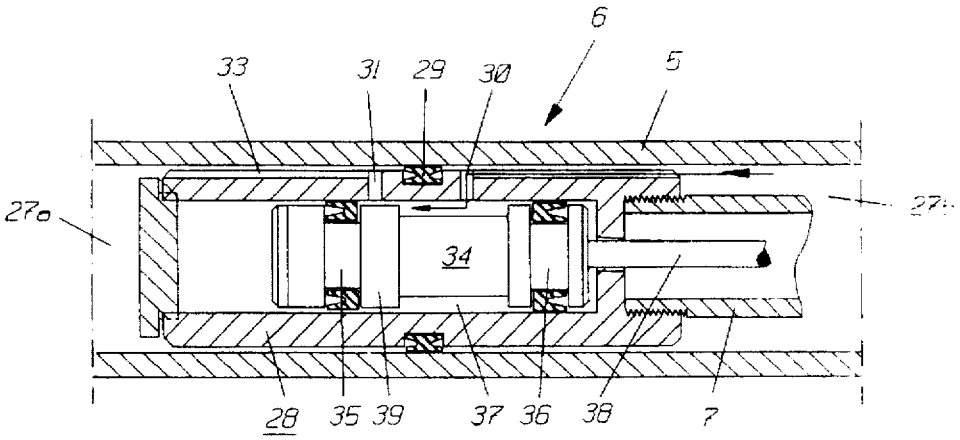
FIGS. 6, 7 and 8 show cross sections though the hydraulic control means of the air cylinder according to the invention in three different functional positions.
Figure 7:
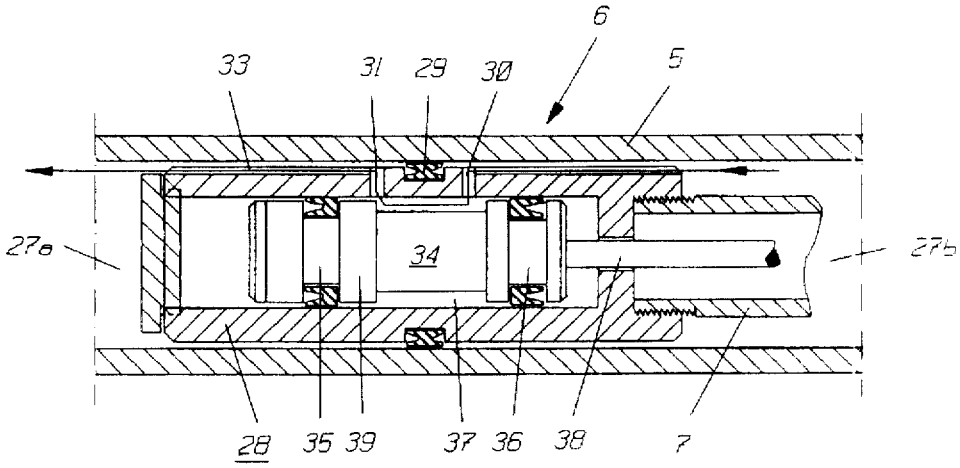
Figure 8:
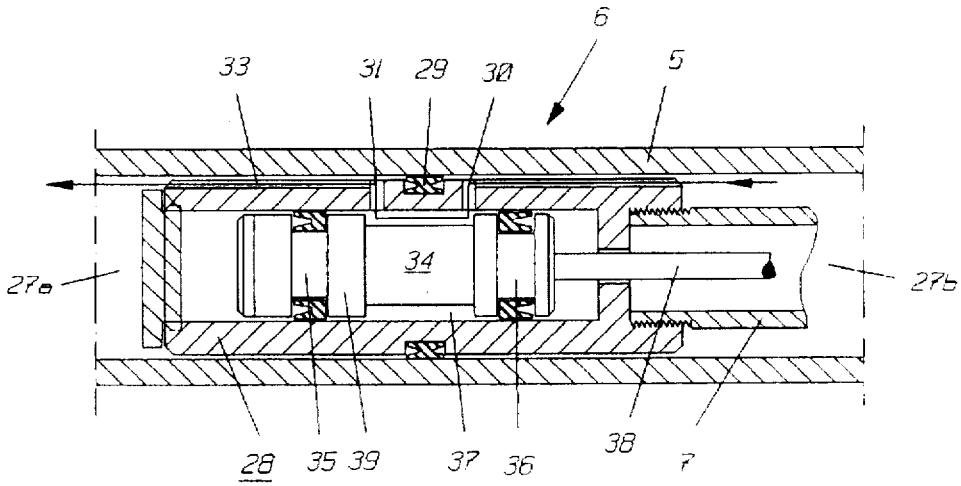

In FIG. 6 the apparatus is shown in a fully closed position, which position is taken when there is no air pressure in any of the channels 18 or 19; in FIG. 7 is shown how the piston 34 opens the hydraulic channel 31 to only about 50% when the cylinder 28 is being moved (following the arrow); and in FIG. 8 is shown that the hydraulic channel 31 is being opened completely upon the actuation of the hydraulic piston 34 under the assistance of the bar 38 and the hydraulic control piston 21 in case compressed air is present in either of the channels 18 or 19 and thereby also in the air side-channels 23 and 24 opening in the acuation chamber 20.

By this possibility of adjusting the optimum size of the opening 31 for the hydraulic control unit 28, 34 it is possible, while maintaining the air pressure in the channel 18 or 19, to provide such a choking of the hydraulic passageway 32-30-37-31-33 that the flow of oil accordingly controls the speed by which the air piston 4 is being displaced in the air cylinder 1. At the same time the flow or oil foresees a uniform, jerk-free movement of the air piston 4 in all moments of the displacement, and a starting of movement of the air piston 4 without the hesitatingly accelerated movement which is otherwise common in air cylinders.

The illustrated apparatus also allows a slow "edging along" with full air pressure and with a normally maximum opening of the channel 30 by a manual, or other, choking of the hydraulic channel in that the bar 38 is actuated via the control nut 8. This also opens the possibility of driving the air piston with maximum speed in one direction and with "edging speed" in the opposite direction.

For making it possible to vary the stroke of the air piston 4 the piston rod 5 can, at the exterior surface thereof, be formed with bar codes, magnetic tapes, optical grooves or any other equivalent means, which are provided on exactly predetermined mutual distances, for instance with a pitch of 1 mm. Readers (not separately numbered) of the bar codes or any similar means are mounted in the position reading channels 15 and 16, and said readers are connected to a central control unit 40 from which control unit also signals are emitted for the air pressure to the main air channels 19 and 20 as indicated in FIG. 1. It is possible to set an exactly predetermined piston stroke by means of the control unit 40, so that the air pressure in the channels 18 and 19 is cut off exactly after the predetermined length of movement of the air piston 4. This can be done in that the control unit comprises a counter means which, after having registered a predetermined number of passing bar codes etc., issues a signal for cutting off the supply of air to the air channel 18 or 19. If the bar codes etc. are provided with a pitch of for instance 1 mm and the positioning channels 15, 16 are arranged offset from each other by 0.5 mm it is obvious that it is possible to set the stroke of the air piston 4 with an accuracy of as little as only 0.5 mm, and this is unique for an air cylinder. It is obvious that not only the piston stroke but also the location of the stroke movement in the axial direction in the air cylinder can be set and varied as desired by settings in the control unit 40.

It is obvious to an expert in this technical field that the central control unit 40 can be formed and constructed in many various ways, and that this is no part of the invention. Therefore the structure of the control unit is left without a close explanation thereof.

The described apparatus operates as follows:

In the initial position there is no air pressure is any of the two main air channels 18 and 19, the control piston 21 of the actuation means 8 is fully expanded rearwardly, and the valve 28, 34 of the hydraulic control unit 6 consequently also is closed.

Movement in the Forward Direction

When compressed air is let into the main air channel 19 air is supplied to the rearwardly facing air pressure chamber **14*b*; at the same time compressed air is passed through the air side-channel 24 and into the chamber 20 of the actuation means, and this makes the actuation piston 21 move forwardly against the action of the spring 22; the lock piston rod 7 which is connected to the piston 21 thereby provides a correspondingly long displacement of the hydraulic cylinder 28, whereby the hydraulic fluid bore 31 is opened and hydraulic fluid can flow from the hydraulic chamber part 27*b*, through the axial channel 32, through the radial bore 30, through the transfer piston chamber 37, through the bore 31 and the axial channel 33 and as far as to the forward hydraulic chamber part 27*a*. This flow of hydraulic fluid from chamber 27*b* to chamber 27*a* makes it possible for the air piston 4 to become displaced an equally long distance forwardly under the actuation of the air pressure in the air chamber 14*b***.

Stop

If the air is thereafter cut off in the main air channel 19 the air pressure is ceased both in the air chamber **14*b* and in the actuation air chamber 20, and this makes the piston 20 of the actuation means become pressed back to its initial position by the spring 22, whereby the hydraulic piston 34 is returned to its initial position thereby closing the radial flow bore 31 of the hydraulic cylinder 28, whereby all flow of hydraulic fluid is immediately stopped. Since the hydraulic fluid generally can be considered incompressible any movement of the air piston 4 thereby is impossible, and the air piston 4 consequently becomes blocked exactly in the position the piston took when the air pressure was ceased in the main air channel 19. The same function occurs if the compressed air by mistake or depending on a function error should drop out in the main air channel 18 or 19. The air piston 4** is effectively blocked in its stop position and can not "creep", not even depending on an external counter force acting on the piston.

Movement Rearwardly

If compressed air is supplied to the main air channel 18 said compressed air will enter the air chamber at the front side **14*a* of the piston 4 through the channels 9, and 13. Concurrently therewith compressed air is supplied to the actuation chamber 20, and the piston 21, and therewith the hydraulic cylinder 28, is moved as previously described. Hydraulic fluid thereby will flow from the front side 27*a* of the hydraulic chamber to the rear side 27*b* of the hydraulic chamber through the channels 33-31-37-30-32, and the air piston 4 is moved a correspondingly long distance rearwardly. The piston is stopped and blocked as previously described as soon as the air is cut off from the main air channel 19**.

Controlling the Moving Speed

For controlling the speed by which the air piston 4 is displaced in the cylinder 1 the maximum opening of the hydraulic channel 31 is choked in that the control nut 8 is tightened. The base position of the piston 34 is thereby adjusted slightly rearwardly (to the right in FIG. 1 ), and by doing so the piston 34, at full displacement of the actuation air piston 21, opens only a minor part of the hydraulic channel 31, and the flow of hydraulic fluid between the hydraulic chambers **27*a* and 27*b* follows more slowly. Correspondingly also the air piston 4** is being displaced, of course, and this is done without the need of reducing the air pressure by which the air piston is being actuated.

Controlling the Piston Stroke

The position readers in the channels 15 and 16 give an information to the central control unit 40 about how many lines etc. have passed, and by a simple adjustment of the control unit 40 it is possible to foresee that the supply of compressed air to the main air channels 18 and 19 is cut off exactly when a predetermined number of code lines etc. have passed the position readers. As mentioned above said position readers may be mounted slightly axially offset each other, for instance by a distance of 0.5 mm, and it is obvious that the piston stroke can thereby be adjusted with an accuracy of only 0.5 mm. It is of course also possible to provide three or even more position readers which are axially offset each other, whereby the length of the piston stroke can be adjusted with still higher accuracy.

Correspondingly the location of the piston stroke can be adjusted in the axial direction by means of the control unit 40, as obvious to the expert. The control unit may be in the form of a simple computer which is connected to a valve system for opening and closing, respectively, of valves for the main air channels 18 and 19.

I claim:

1. A pneumatic piston-cylinder unit comprising:

an air cylinder;

an air piston reciprocatable in said air cylinder and which divides said air cylinder into first and second sides;

a tubular piston rod attached to said air piston including a hydraulic chamber which is filled with a hydraulic liquid;

first and second air channels by which compressed air is selectively fed to the first and second sides of said air cylinder;

an integrated hydraulic control system including (a) a hydraulic cylinder which is located within said hydraulic chamber of said tubular piston rod and which is movable a limited distance with respect to said air cylinder from a first position to a second position, (b) a hydraulic piston in said hydraulic cylinder which is stationary with respect to said air cylinder so that movement of said hydraulic cylinder moves said hydraulic cylinder relative to said hydraulic piston, and (c) a liquid flow path between said hydraulic cylinder and said hydraulic piston which is closed when said hydraulic cylinder is in the first position and which is opened when said hydraulic cylinder is in the second position; and an actuation means, which is fixedly mounted in said cylinder, (i) for moving said hydraulic cylinder to the second position and hence for opening the liquid flow path when compressed air is present in either of said first and second air channels whereby said air piston is movable in said air cylinder by the compressed air, and (ii) for moving said hydraulic cylinder to the first position and hence for closing the liquid flow path when compressed air is absent from both of said first and second air channels whereby any movement of said air piston relative to said air cylinder is prevented by the closing of said liquid flow path.

2. A pneumatic piston-cylinder unit as claimed in claim 1 wherein said liquid flow path includes an opening which is closed when said hydraulic cylinder is in the first position and which is opened when said hydraulic cylinder is in the second position; and wherein said actuation means includes a control means for adjustably controlling the limited distance of movement of said hydraulic cylinder to the second position whereby a size of the opening of said liquid flow path is adjustably controlled and hence a moving speed of said air piston is adjustably controlled.

3. A pneumatic piston-cylinder unit as claimed in claim 2 wherein said opening of said liquid flow path is radially directed.

4. A pneumatic piston-cylinder unit as claimed in claim 1 wherein said actuation means includes (a) a tubular lock piston rod connected at a first end to said hydraulic cylinder and which sealingly extends through said air piston, (b) an actuation chamber located in a rearward end piece of said air cylinder, (c) an actuation piston mounted for reciprocating movement in said actuation chamber and to which a second end of said tubular lock piston rod is connected, and (d) a compression spring located in said actuation chamber which biases said actuation piston so that said tubular lock piston rod in turn biases said hydraulic cylinder toward the first position.

5. A pneumatic piston-cylinder unit as claimed in claim 4 wherein said actuation means further includes first and second air side channels which fluidly communicate respectively with said first and second air channels with a side of said actuation piston opposite to said compression spring whereby when compressed air is present in either of said first and second air channels the compressed air is communicated through the respective first or second air side channel to the side of said actuation piston opposite said compression spring so that the compressed air moves said actuation piston against the bias of said compression spring and hence moves said hydraulic cylinder from the first position to the second position.

6. A pneumatic piston-cylinder unit as claimed in claim 2 wherein said actuation means includes (a) a tubular lock piston rod connected at a first end to said hydraulic cylinder and which sealingly extends through said air piston, (b) an actuation chamber located in a rearward end piece of said air cylinder, (c) an actuation piston mounted for reciprocating movement in said actuation chamber and to which a second end of said tubular lock piston rod is connected, and (d) a compression spring located in said actuation chamber which biases said actuation piston so that said tubular lock piston rod in turn biases said hydraulic cylinder toward the first position.

7. A pneumatic piston-cylinder unit as claimed in claim 6 wherein said actuation means further includes first and second air side channels which fluidly communicate respectively with said first and second air channels with a side of said actuation piston opposite to said compression spring whereby when compressed air is present in either of said first and second air channels the compressed air is communicated through the respective first or second air side channel to the side of said actuation piston opposite said compression spring so that the compressed air moves said actuation piston against the bias of said compression spring and hence moves said hydraulic cylinder from the first position to the second position.

8. A pneumatic piston-cylinder unit as claimed in claim 7 wherein said control means includes (a) a bar attached at a first end to said hydraulic piston and which extends through said tubular lock piston rod and through said actuation piston to a second end located at a rear side of said rearward end piece of said air cylinder, and (b) a control nut movably mounted on said second end of said bar whereby a position of said hydraulic piston relative to said air cylinder is adjustable and hence the size of the opening of said liquid flow path is controlled.

9. A pneumatic piston-cylinder unit as claimed in claim 1 wherein said piston rod includes indication lines on an exterior surface thereof which are spaced from one another by an exact pitch; and further including (a) a position reading means located at a front end of said air cylinder for reading said indication lines passing thereby during a movement of said tubular piston rod, and (b) a central control unit connected to said reading means which registers the number of lines passing said reading means and which cuts off a flow of compressed air to said first and second air channels when a predetermined number of lines have been registered corresponding to a desired position of said piston rod.

10. A pneumatic piston-cylinder unit as claimed in claim 9 and further including a second position reading means for reading said indication lines passing thereby during a movement of said tubular piston rod which is axially offset by a predetermined distance along said piston rod from said first-mentioned reading means and which is also connected to said central control unit whereby said control unit utilizes readings from both of said reading means to determine when the piston rod has reached the desired position.

11. A pneumatic piston-cylinder unit as claimed in claim 1 and further including a closable valve at an exterior end of said tubular piston rod remote from said air piston through which hydraulic liquid is introduced into said hydraulic chamber.

* * * * *